US008052450B2

(12) United States Patent
Li et al.

(10) Patent No.: US 8,052,450 B2
(45) Date of Patent: Nov. 8, 2011

(54) CARD EDGE CONNECTOR WITH IMPROVED RETAINER

(75) Inventors: Zhuang-Xing Li, Kunshan (CN); Xiao-Zhi Fu, Kunshan (CN); Xue-Wu Bu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/978,518

(22) Filed: Dec. 24, 2010

(65) Prior Publication Data

US 2011/0177707 A1 Jul. 21, 2011

(30) Foreign Application Priority Data

Jan. 19, 2010 (CN) ..... 2010 20 300955

(51) Int. Cl.
*H01R 13/62* (2006.01)

(52) U.S. Cl. ..... 439/327; 439/153

(58) Field of Classification Search ..... 439/160, 439/327, 153, 155, 157
See application file for complete search history.

(56) References Cited

U.S. PATENT DOCUMENTS

| | | | | |
|---|---|---|---|---|
| 4,826,447 | A * | 5/1989 | Forker et al. | 439/328 |
| 6,361,344 | B1 * | 3/2002 | Yu | 439/328 |
| 6,368,124 | B1 | 4/2002 | Wang | |
| 6,672,888 | B1 * | 1/2004 | Ku | 439/153 |
| 7,029,300 | B2 * | 4/2006 | Tsai | 439/160 |
| 7,121,862 | B2 | 10/2006 | Tang et al. | |
| 2005/0009396 | A1 * | 1/2005 | Wu | 439/327 |

* cited by examiner

*Primary Examiner* — Briggitte R Hammond
(74) *Attorney, Agent, or Firm* — Wei Te Chung; Andrew C. Cheng; Ming Chieh Chang

(57) ABSTRACT

A card edge connector includes an elongated housing, a plurality of contacts retained to the housing, and a retainer located at one end of the housing along an elongated direction of the housing. The housing has a pair of side walls and a central slot between the side walls. The retainer has a resilient retention arm and a rigid stop arm diverging from the retention arm along a transverse direction perpendicular to the elongated direction. The retention arm has a locking section extending along the elongated direction to lock a daughter board and an operating section obliquely extending from the locking section along a third direction different from both elongated direction and transverse direction. The stop arm has an abutting section behind the operating section along a fourth direction perpendicular to the operating section to limit a deflection of the operating section.

19 Claims, 5 Drawing Sheets

CARD EDGE CONNECTOR WITH IMPROVED RETAINER

BACKGROUND OF THE INVENTION

1. Field of the Invention

The present invention relates to card edge connectors, more particularly to card edge connector with an improved retainer.

2. Description of Related Art

Card edge connectors are employed widely in computers to be soldered on a mother board for receiving a daughter board. The card edge connector usually has an elongated housing and a plurality of contacts retained in the housing for electrically connecting the daughter board and the mother board. The housing has a body portion and a retainer at one end thereof. The body portion has a pair of side walls and a central slot between the side walls for receiving the daughter board. Each contact has a contact portion protruding into the central slot.

The retainer extends along an elongated direction from one side wall, and is located at one side of the central slot along the elongated direction. The retainer has a resilient retention arm which is deflectable from an initial position to a final position, and a rigid stop arm located at an outer side of the resilient arm and diverging with respect to the retention arm along a transverse direction of the housing. The retention arm has a locking section extending along the elongated direction from the side wall and an operating section obliquely extending from a free end of the locking section. The locking section is formed with a latching projection inwardly extending from an inner side thereof to lock the daughter board in a non-deflected position of the retention arm. The rigid stop arm is located at an outer side of the locking section for limiting the deflection of the locking section in order to avoid excessive stress or strain occurring in the locking section.

However, the stop arm is merely located at the outer side of the locking section, while does not extend to an outer side of the operating section, thereby when the operating section is pulled by an excessive stress or strain to drive the locking section outwardly for ejecting the daughter board, the operating arm or stop arm is easily broken.

Hence, an improved card edge connector is desired to overcome the above problems.

BRIEF SUMMARY OF THE INVENTION

According to one aspect of the present invention, a card edge connector, comprises: an elongated housing having a pair of side walls and a central slot between the side walls; a plurality of contacts retained to the housing, each contact having a contact portion protruding into the central slot; and a retainer located at one end of the housing along an elongated direction of the housing, the retainer having a resilient retention arm and a rigid stop arm diverging from the retention arm along a transverse direction perpendicular to the elongated direction; wherein the retention arm has a locking section extending along the elongated direction to lock a daughter board and an operating section obliquely extending from the locking section along a third direction different from both elongated direction and transverse direction, and the stop arm has an abutting section behind the operating section along a fourth direction perpendicular to the operating section to limit a deflection of the operating section.

According to another aspect of the present invention, a retainer adapted to be combined with a card edge connector for securing a daughter board in the card edge connector, comprises: a base portion; a resilient retention arm extending from the base portion, the retention arm having a locking section with a latching projection to lock the daughter board and an operating section which can be pulled to drive the locking section to move outwardly for releasing the daughter board; and a rigid stop arm extending to an outer side of the operating section from the base portion to directly limit a deflection of the operating section.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
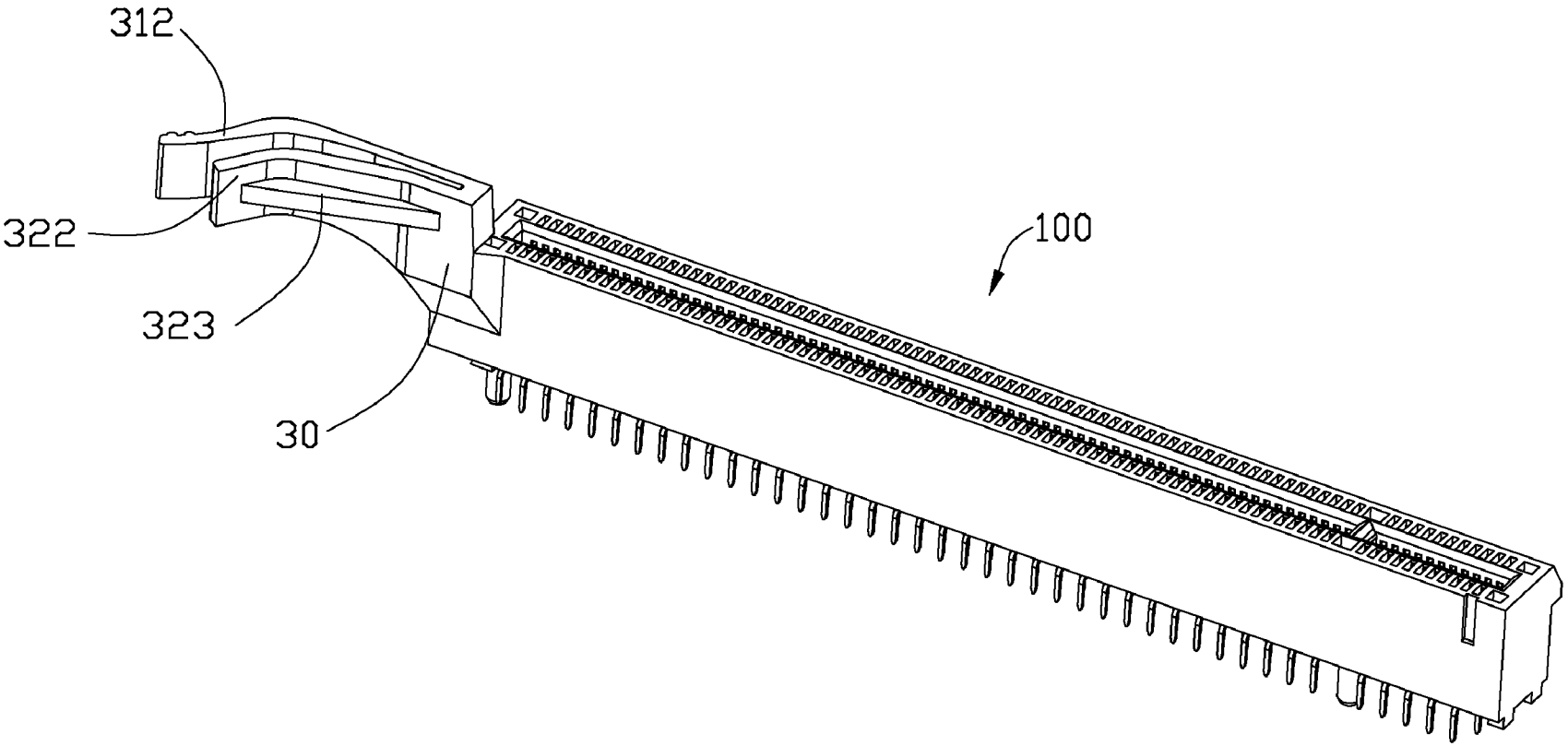
FIG. 1 is a perspective view of a card edge connector according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
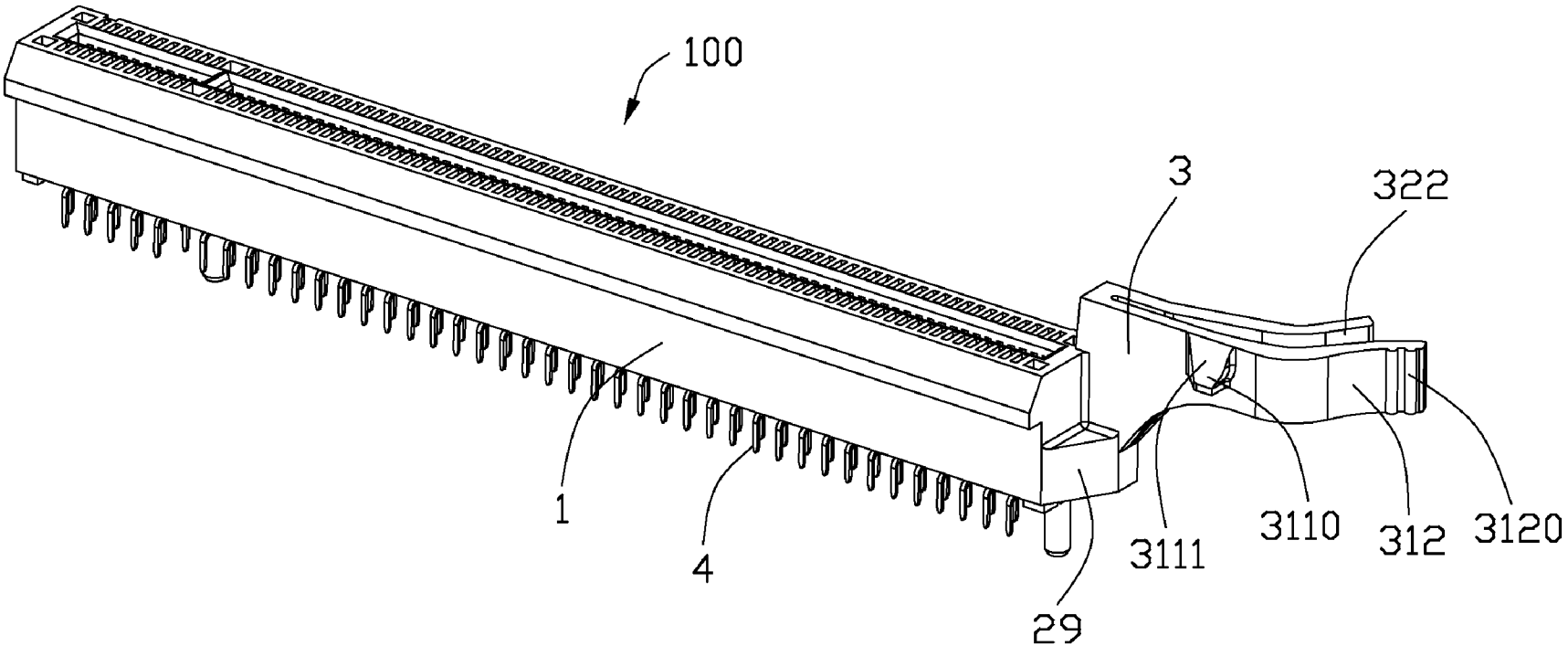
FIG. 2 is a view similar to FIG. 1, while taken from a second aspect.

Referring to FIGS. 1-2, a card edge connector 100 according to the present invention for being soldered to a mother board (not shown) to mate with a daughter board (not shown) is disclosed. The card edge connector 100 comprises an elongated housing 1, a retainer 3 at one end of the housing 1, and a plurality of contacts 4 retained in the housing 1.

Figure 3:
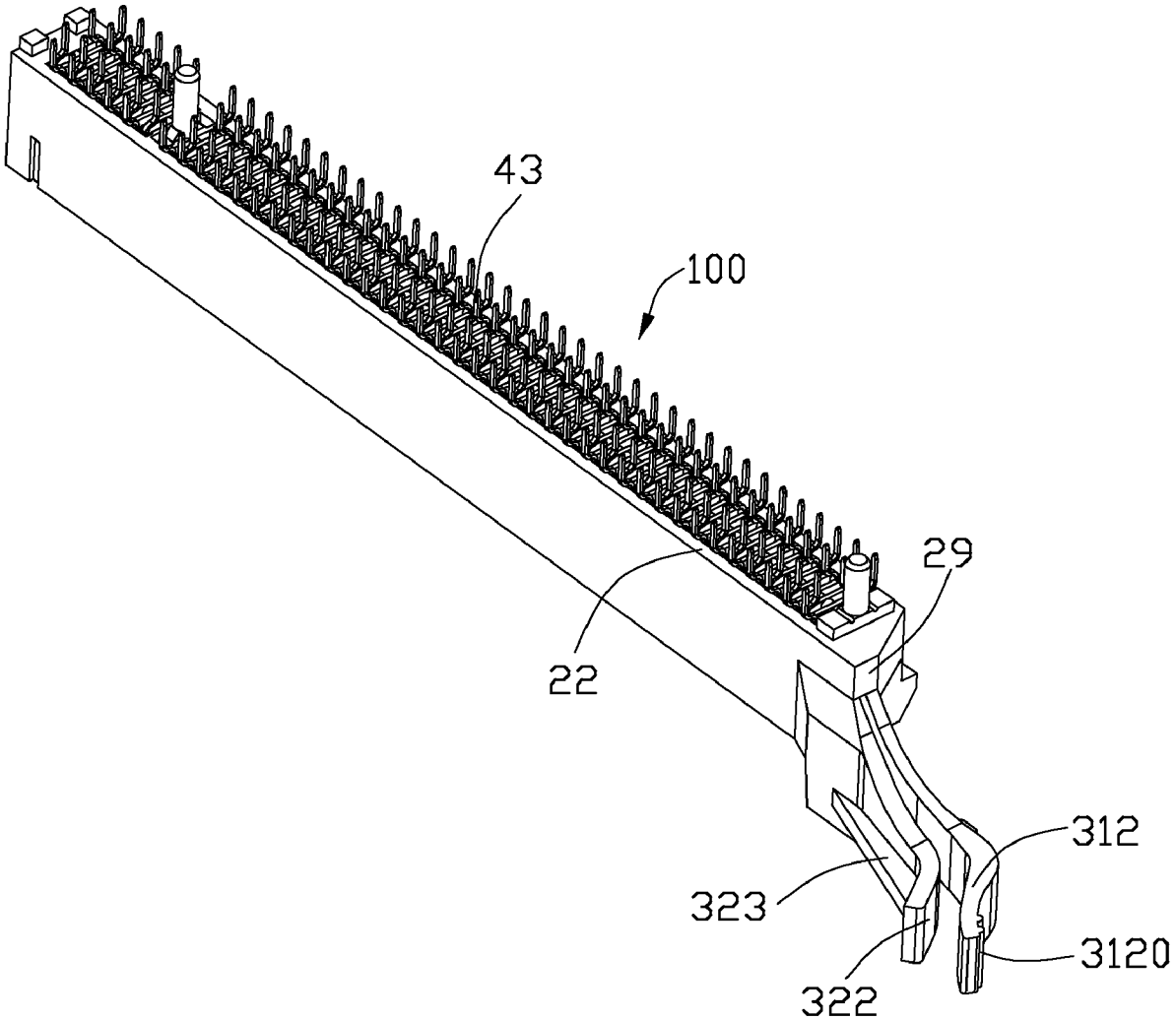
FIG. 3 is a view similar to FIG. 1, while taken from a third aspect.
Figure 4:
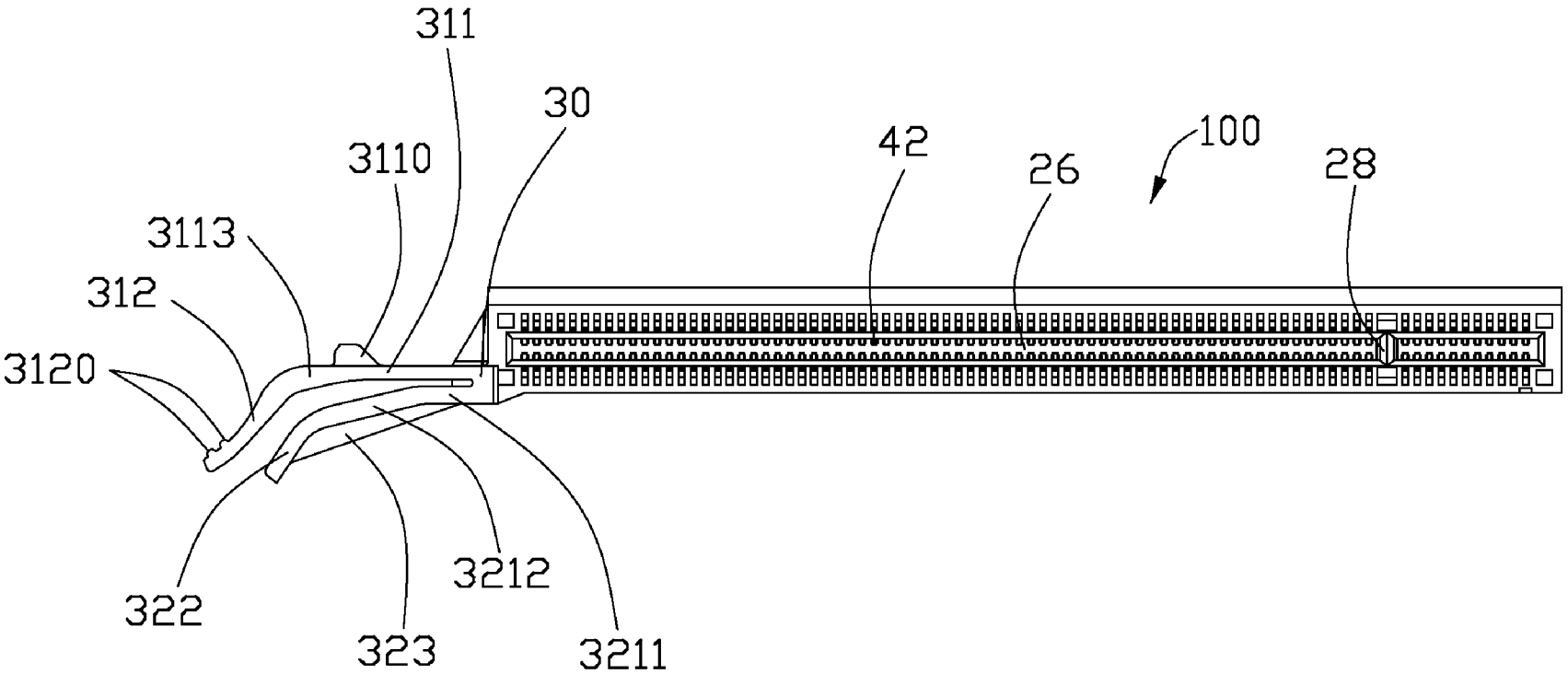
FIG. 4 is a top plan view of the card edge connector.
Figure 5:
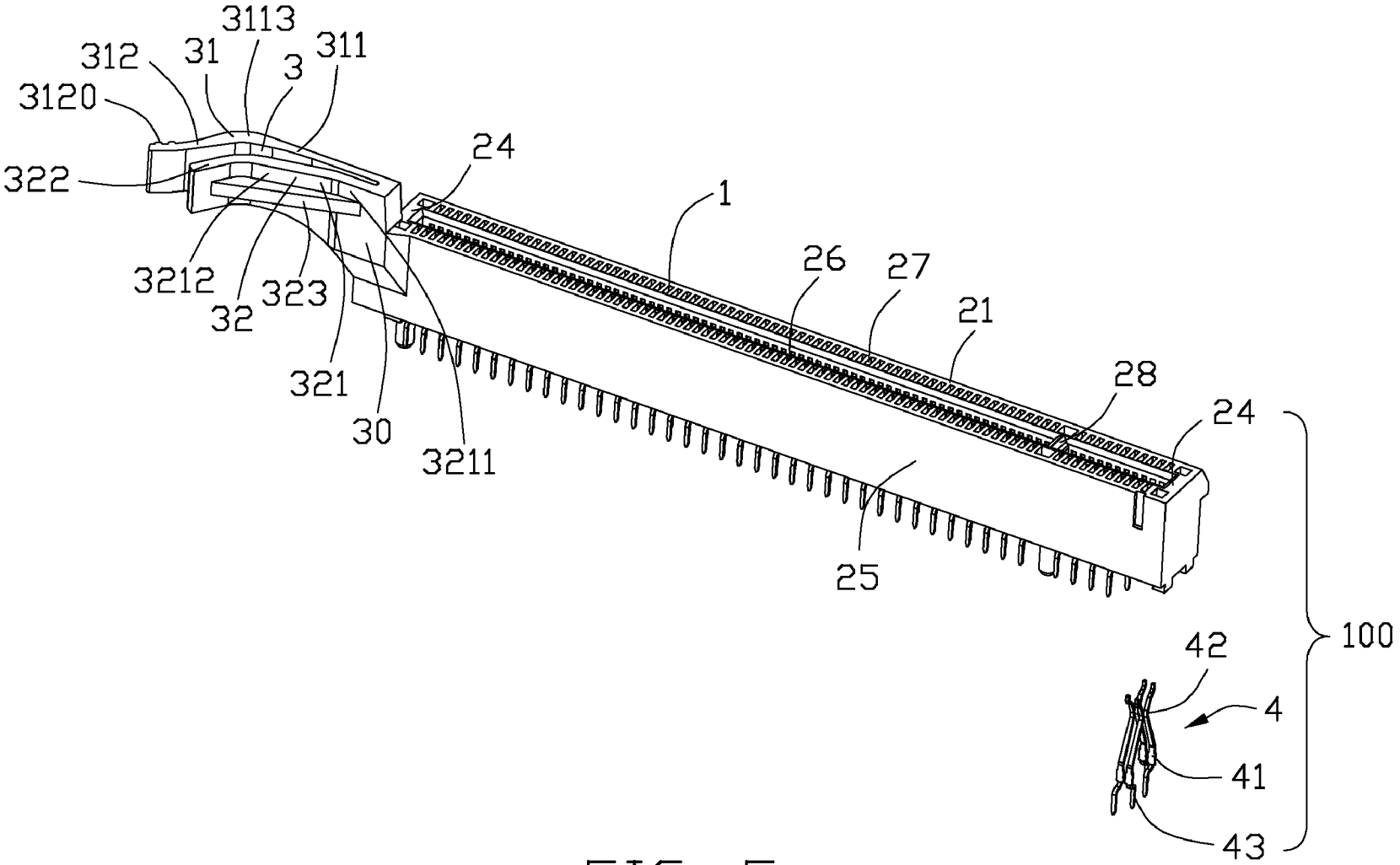
FIG. 5 is a partly exploded view of the card edge connector shown in FIG. 1.

Referring to FIGS. 3-5, the housing 1 extends along an elongated direction thereof, and has a top surface 21, a bottom surface 22, a pair of side walls 25, a pair of end walls 24 at two ends thereof, an elongated central slot 26 between the side walls 25, and a partition board 28 extending into the central slot 26 to divide the central slot 26 into two parts which have different lengths. The central slot 26 defines a central line along the elongated direction. The side walls 25 are respectively located at two sides of the central line. Each side wall 25 defines a plurality of passageways 27 extending therethrough along a top to down direction. The passageways 27 communicate with the central slot 26 along a transverse direction which is perpendicular to the elongated direction. The elongated direction is a first direction, and the transverse direction is a second direction in the present invention.

Each contact 4 has a securing portion 41 retained in the passageways 27, a contact portion 42 protruding into the central slot 26 to electrically connect with the daughter board, and a soldering portion 43 downwardly extending out of the housing 1 to connect with the mother board.

Referring to FIGS. 2-5, the retainer 3 unitarily extends from one end wall 24 and aligns to one side wall 25 to be substantially located at one side of the central line. The retainer 3 upwardly extends beyond the top surface 21 of the housing 1 and laterally extends beyond the side wall 25 for being conveniently operated. The retainer 3 has a base portion 30 extending from the end wall 24, a retention arm 31 extending from the base portion 30 along the elongated direction, and a rigid stop arm 32 extending from the base portion 30 and located behind the retention arm 31 along the transverse direction. The housing 1 has a protrusion 29 extending from a lower side of the end wall 24 from which the retainer 3 extends. The protrusion 29 connects with a lower side of the base portion 30 to strengthen the retainer 3 and prevent the base portion 30 from being broken.

The retention arm 31 has a locking section 311 connecting with the base portion 30 and extending along the elongated direction, an operating section 312 extending from the locking section 311 along a third direction different from both the elongated direction and the transverse direction, and a transition portion 3113 connecting the locking section 311 and the operating section 312. The transition portion 3113 is thicker than the locking section 311 and the operating section 312 for strengthening the retention arm 30. The locking section 311 has a latching projection 3110 protruding toward and beyond the central line from an inner surface of the locking section 311 along the transverse direction to lock the daughter board. The latching projection 3110 has an oblique upper plane 3111 to guide an insertion of the daughter board. The operating section 312 is formed with a plurality of ribs 3120 in order to be used conveniently.

The stop arm 32 has a limiting section 321 extending from the base portion 30, and an abutting section 322 unitarily extending from a free end of the limiting section 321. The limiting section 321 is located behind the locking section 311 along the transverse direction to form a gap therebetween for limiting a deflection of the locking section 311. Besides, the limiting section 321 and the locking section 311 diverge from each other whereby the gap is increased along the elongated direction. The limiting section 321 has a first section 3211 connecting with the base portion 30 and a second section 3212 obliquely connecting the first section 3211 and the abutting section 322. The first section 3211 extends along the elongated direction and is parallel to the locking section 311.

The abutting section 322 is located behind the operating section 312 along a fourth direction perpendicular to the operating section 312 for limiting a deflection of the operating section 312. The abutting section 322 and the operating section 312 defines a space therebetween along the fourth direction for supplying a deflection range to the operating section 312. The operating section 312 defines a length which is longer than the abutting section 322 along the third direction for being operated conveniently. The space is larger than the gap. The stop arm 32 further has a block 323 unitarily connecting with an outer surface thereof. The block 323 is perpendicular to the limiting section 321 and the abutting section 322, and extends from the base portion 30 to a free end of the abutting section 322 for strengthening the stop arm 32.

In an insertion process of the daughter board, a lower edge of the daughter board resists the oblique upper plane 3111 to push the retention arm 31 laterally. When the daughter board is completely inserted into the card edge connector 100, the retention arm 31 rebounds to make the latching projection 3110 extend into a notch of the daughter board for locking the daughter board.

In a withdrawn process of the daughter board, pulling the operating section 312 outwardly, then the locking section 311 is driven to move outwardly for making the latching projection 3110 leave out of the notch of the daughter board, then the daughter board would be pulled out of the card edge connector 100. In the pulling process of the operating section 312, the locking section 311 gradually resists the first section 3211 and the second section 3212 of the limiting section 321 to limit the deflection of the locking section 311 in order to avoid excessive stress or strain occurring in the locking section 311. In other words, the limiting section 321 defines the deflection position of the locking section 311. Of course, the limiting section 321 also serves as a support for a user's finger (not shown) in manually deflecting the locking section 311.

Besides, the retainer 3 in the present invention further has said abutting section 322 behind the operating section 312 along the fourth direction. When the user pulls the operating section 312 with an excessive stress or strain, the abutting section 322 can limit the deflection of the operating section 312, in other words, the abutting section 322 defines the deflection position of the operating section 312 and serves as a support for preventing the operating section 312 from being overly pulled and broken. Furthermore, an inner surface of the abutting section 322 abuts against an outer surface of the operating section 312 to form a face to face contact therebetween, which can disperse a stress or strain on the operating section 312 and the abutting section 322 for preventing the operating section 312 from being broken easily. In addition, the stop arm 32 has said block 323 which perpendicularly connects the outer surface of the stop arm 32 and extends from the base portion 30 to the free end of the abutting section 322, thereby the block 323 can strengthen the stop arm 32 to prevent the stop arm 32 from being broken.

As fully described above, the retainer 3 in the present invention is unitarily formed with the housing 1, while the retainer 3 can be alternatively designed to be separate from the housing 1, then the retainer 3 can be formed with a clip to retained on one end wall 24 of the housing 1, or formed with a post which directly positions the retainer 3 to the mother board and located at one side of a card edge connector to combine with the card edge connector for locking the daughter board, which can also achieve the purpose of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated housing having a pair of side walls and a central slot between the side walls;

a plurality of contacts retained to the housing, each contact having a contact portion protruding into the central slot; and a retainer located at one end of the housing along an elongated direction of the housing, the retainer having a resilient retention arm and a rigid stop arm diverging from the retention arm along a transverse direction perpendicular to the elongated direction;

wherein the retention arm has a locking section extending along the elongated direction to lock a daughter board and an operating section obliquely extending from the locking section along a third direction different from both elongated direction and transverse direction, and the stop arm has an abutting section behind the operating section along a fourth direction perpendicular to the operating section to limit a deflection of the operating section, and the stop arm extends beyond the locking section along the elongated direction.

2. The card edge connector as claimed in claim 1, wherein the retainer has a base portion extending from one side wall of the housing, and the retention arm and the stop arm unitarily extend from the base portion.

3. The card edge connector as claimed in claim 2, wherein the locking section has a latching projection extending inwardly along the transverse direction for locking the daughter board, and the stop arm has a limiting section directly extending from the base portion and located behind the locking section to form a gap therebetween for limiting a deflection of the locking section.

4. The card edge connector as claimed in claim 3, wherein the limiting section and locking section diverge with respect to each other whereby the gap is increased along the elongated direction, and the abutting section unitarily extends from a free end of the limiting section.

5. The card edge connector as claimed in claim 4, wherein the abutting section and the operating section define a space therebetween along the fourth direction, and the space is larger than the gap.

6. The card edge connector as claimed in claim 4, wherein the limiting section has a first section parallel to the locking section and a second section obliquely connecting the first section and the abutting section.

7. The card edge connector as claimed in claim 4, wherein the stop arm has a block perpendicular to the limiting section and the abutting section, and the block extends from the base portion to a free end of the abutting section.

8. The card edge connector as claimed in claim 7, wherein the block unitarily connects with an outer surface of the stop arm.

9. The card edge connector as claimed in claim 2, wherein the housing is formed with a protrusion connecting a lower side of the base portion, and the retainer extends beyond a top surface of the housing along a top to down direction and outwardly extends beyond the side wall along the transverse direction.

10. A retainer adapted to be combined with a card edge connector for securing a daughter board in the card edge connector, comprising:

a base portion;

a resilient retention arm extending from the base portion, the retention arm having a locking section with a latching projection to lock the daughter board and an operating section which can be pulled to drive the locking section to move outwardly for releasing the daughter board; and a rigid stop arm extending to an outer side of the operating section from the base portion to directly limit a deflection of the operating section;

wherein the stop arm has a first section parallel to the locking section, a second section obliquely extending from the first section and an abutting section obliquely extending from the second section and located behind the operating section along an extension direction of the latching projection.

11. The retainer as claimed in claim 10, wherein the retention arm and the stop arm define a gap which is increased from initial positions thereof to free ends thereof.

12. The retainer as claimed in claim 10, wherein the stop arm has a block perpendicular to the stop arm and extending from the base portion to a free end of the abutting section.

13. The retainer as claimed in claim 12, wherein the block unitarily connects with an outer surface of the stop arm.

14. A card edge connector comprising:

an insulative elongated housing defining therein a slot extending along a longitudinal direction and communicating with an exterior in a vertical direction perpendicular to said longitudinal direction;

a plurality of contacts disposed in the housing and by two sides of the slot;

a retainer unitarily formed on one end of the housing and including a resilient retention arm with a locking section thereon and a rigid stop arm located, with a gap, behind the retention arm in a transverse direction perpendicular to both said longitudinal direction and said vertical direction; wherein said rigid stop arm is equipped with a block unitarily formed on a back surface of the stop arm.

15. The card edge connector as claimed in claim 14, wherein said rigid stop arm extends in a backwardly curved manner, and said block prevents deformation of said rigid stop arm which increases magnitude of said curved manner.

16. The card edge connector as claimed in claim 15, wherein said block is located at a mid level of said rigid stop arm.

17. The card edge connector as claimed in claim 15, wherein said block essentially extends in a horizontal manner.

18. The card edge connector as claimed in claim 14, wherein said housing defines a top face through which said slot communicates with the exterior, and both said resilient retention arm and said rigid stop arm extend above said top face and leave sufficient space thereunder for easy manual operation.

19. The card edge connector as claimed in claim 14, wherein a protrusion is unitarily formed around a joint of said resilient retention arm and the end of the housing and is located adjacent to a bottom face of the housing.

* * * * *